US005717193A

United States Patent [19]

Marcelo

[11] Patent Number: 5,717,193

[45] Date of Patent: Feb. 10, 1998

[54] METHOD AND APPARATUS FOR DETERMINING THE EXPONENTIAL POWERS OF "I"

[76] Inventor: Ruben V. Marcelo, 765 Bronx River Rd., Bronxville, N.Y. 10708

[21] Appl. No.: 734,134

[22] Filed: Oct. 21, 1996

Related U.S. Application Data

[62] Division of Ser. No. 217,448, Mar. 24, 1994, Pat. No. 5,569,896.

[51] Int. Cl.[6] ..... G06G 1/02

[52] U.S. Cl. ..... 235/69; 235/70 R; D18/9

[58] Field of Search ..... 235/70 R, 70 A, 235/70 C, 69, 83, 89 A, 89 R; D18/9

[56] References Cited

U.S. PATENT DOCUMENTS

| | | | |
|---|---|---|---|
| 3,610,519 | 10/1971 | Radosavljevic | 235/61 GM |
| 3,639,733 | 2/1972 | Larson | 235/69 |
| 3,699,313 | 10/1972 | Huo | 235/64.3 |
| 4,960,029 | 10/1990 | Nelson | 235/70 R |
| 5,569,896 | 10/1996 | Marcelo | 235/70 R |

*Primary Examiner*—Edward Tso
*Attorney, Agent, or Firm*—Mark P. Stone

[57] ABSTRACT

The present invention provides methods and apparatus for readily determining the value of the imaginary number "i" raised to different exponential powers. Calculations pertaining to the imaginary "i" are commonly encountered in engineering, mathematical and scientific calculations and analysis. In accordance with the present invention, the value of "i" raised to any magnitude of exponential power is readily determined based upon the values of the "ones" and "tens" place of the exponent, including whether the "tens" value is an even or odd integer. Different apparatus are provided for readily calculating the value of the imaginary number "i" for any natural number of exponential power.

18 Claims, 10 Drawing Sheets

METHOD AND APPARATUS FOR DETERMINING THE EXPONENTIAL POWERS OF "I"

This application is a division of application Ser. No. 08/217,448 filed Mar. 24, 1994 (now U.S. Pat. No. 5,569, 896, issued Oct. 29, 1996).

BACKGROUND OF THE INVENTION

The imaginary number "i" is defined to be the square root of −1. It is well known that the concept of the imaginary number "i" is essential in performing numerous mathematical, scientific and engineering calculations. When the value "i" is squared, the result is the negative integer one (−1); the value of "i" raised to the third power results in −i; and the value of "i" raised to the fourth power exponential results in the positive integer 1 (+1). Thereafter, the sequential values of "i" raised to successive continuous exponential powers repeat—e.g., "i" taken to the 5th exponential power equals "i"; "i" taken to the 6th exponential power equals negative one (−1); "i" taken to the 7th exponential power equals negative "−i" (−i); and "i" taken to the 8th exponential power equals the positive integer one (+1).

Equations derived from the repeating sequence of values of "i" taken to successive, continuous exponential powers, where "N" is a natural number, are: $i^{4N}=1$; $i^{4N+1}=i$; $i^{4N+2}=-1$; and $i^{4N+3}=-i$. For example, based upon the above equations, $i^{16}=i^{4(4)}=1$; $i^{17}=i^{4(4)+1}=i$; $i^{18}=i^{4(4)+2}=-1$; and $i^{19}=i^{4(4)+3}=-i$.

The above information and calculations concerning the repetitive values of the imaginary number "i" raised to successive continuous exponential powers is well known to the art. The following Matrix A has been formulated using the exponents cross-references with the four powers of "i".

MATRIX A

| | | | | | |
|---|---|---|---|---|---|
| i | 1 | 5 | 9 | 13 | 17 |
| −1 | 2 | 6 | 10 | 14 | 18 |
| −i | 3 | 7 | 11 | 15 | 19 |
| 1 | 4 | 8 | 12 | 16 | 20 |

The following Matrix B employs only digits that the numbers one to twenty have in common. It is noted that the number ten and twenty and every sequence of ten rotates in the −1 and 1 positions.

MATRIX B

| | | | | | |
|---|---|---|---|---|---|
| i | 1 | 5 | 9 | 3 | 7 |
| −i | 2 | 6 | 0 | 4 | 8 |
| −i | 3 | 7 | 1 | 5 | 9 |
| 1 | 4 | 8 | 2 | 6 | 0 |

Matrix C illustrates only the first nine digits of Matrix B because the numbers ten, twenty, thirty, forty . . . influence the next rotating nine numbers.

MATRiX C

| | | | |
|---|---|---|---|
| i | 1 | 5 | 9 |
| −1 | 2 | 6 | |
| −i | 3 | 7 | |
| 1 | 4 | 8 | |

The folowing Matrix D is expanded to include the influence of the numbers ten and twenty. The number ten includes the odd number one in the tens digit and ten is represented by −1 in Matrix A. The number twenty has the even number (i.e., 2) in the tens digit position, and the number twenty is represented by numeral 1 in Matrix A.

MATRIX D

| TENS DIGIT | ONES DIGIT | | | |
|---|---|---|---|---|
| | i | 1 | 5 | 9 |
| odd = −1 | −1 | 2 | 6 | |
| even = 1 | −i | 3 | 7 | |
| | 1 | 4 | 8 | |

The final version of the table must include the number zero. Referring to Matrix D, the number zero as a tens digit is even and is represented by the numeral 1. The number zero as a ones digit is positive one, which takes into consideration zero as the exponent in $i^0=1$ because any number raised to a 0 exponential power is defined as being 1. Matrix E, represented below, condenses the information derived from the preceding matrices.

MATRIX E

| TENS DIGIT | ONES DIGIT | | | | |
|---|---|---|---|---|---|
| | i | | 1 | 5 | 9 |
| odd = −1 | −1 | | 2 | 6 | |
| even = 1 | −i | | 3 | 7 | |
| | 1 | 0 | 4 | 8 | |

Examples of calculations of the imaginary number "i" raised to the different exponential powers based upon Matrix E are illustrated below.

| | TENS DIGIT | ONES DIGIT | MULTIPLY | ANS. |
|---|---|---|---|---|
| $i^{16}$ | 1 is odd = −1 | 6 = −1 | (−1) (−1) | 1 |
| $i^{17}$ | 1 is odd = −1 | 7 = −i | (−1) (−i) | i |
| $i^{18}$ | 1 is odd = −1 | 8 = 1 | (−1) (1) | −1 |
| $i^{19}$ | 1 is odd = −1 | 9 = i | (−1) (i) | −i |
| $i^{20}$ | 2 is even = 1 | 0 = 1 | (1) (1) | 1 |

It is apparent from the above examples that Matrix E provides an alternative to the step of factoring the exponential powers to which the imaginary number "i" is raised. Matrix E advantageously is easy to remember and uses only the values of the tens and ones digit to solve the problem regardless of the magnitude of the exponent to which "i" is raised.

Although Matrix E eliminates the operation of factoring the exponential powers of "i", it is advantageous to eliminate any type of mental steps in the problem solution process. Matrix E discloses two variations for each power of "i", respectively, for the ones digit indicating odd or even. If "d" represents the "odd" condition, and if "e" represents the "even" condition, the following Matrix F is derived.

MATRIX F

| | | | | | |
|---|---|---|---|---|---|
| i | e1 | d3 | e5 | d7 | e9 |
| −1 | d0 | e2 | d4 | e6 | d8 |
| −i | d1 | e3 | d5 | e7 | d9 |
| 1 | e0 | d2 | e4 | d6 | e8 |

A physical structure can be constructed to represent two variations without any type of mental process being employed by the user during the solution of a problem.

It is a primary object of the present invention to provide methods and apparatus for determining the value of the imaginary number "i" raised to any exponential power based upon the values of the ones and tens digit of the exponent to which the imaginary number "i" is being raised. The methods and apparatus of the present invention eliminate the step of factoring exponential powers, and provide the correct answer to the problem based exclusively on the value of the tens and ones digit of the exponent. Other advantages and features of the present invention will become apparent from the following further description of the invention in conjunction with the drawings.

SUMMARY OF THE INVENTION

The present invention provides methods and apparatus for readily determining the value of the imaginary number "i" raised to any real number exponential power, regardless of the magnitude of the exponent, without the need to perform the step of factoring the exponential powers of "i" to obtain one of the four possible answers (ie, i −1, −i, and 1). The methods and apparatus of the present invention avoid complicated calculations because the solution is dependent only upon the value of the numbers in the tens and ones digit of the exponent, regardless of the magnitude of the exponent. Although the invention is primarily directed to exponential powers which are real, positive numbers, the invention is nonetheless useful in connection with variations of exponential powers. For example, an imaginary number raised to a negative exponential power is equivalent to the same imaginary number raised to the corresponding positive exponential power, but inverted. Therefore, the problem $i^{-49}$ can be solved by recognizing that the number is equivalent to $1/i^{49}$. The methods and apparatus of the present invention are useful to solve the value of $i^{49}$, and thus the answer to the problem is the solution derived from the present invention, but inverted.

The apparatus in accordance with the present invention include devices having indicia corresponding to the tens and ones digit of exponential values to which the imaginary number "i" is raised, and corresponding structure including moving slides, alignment means for numerical scales, and window structures to designate a solution to a problem based upon the value and status (e.g., odd or even) of the ones and/or tens digit of the exponential power. The apparatus in accordance with the methods of the present invention eliminate mental process steps, including factoring of the exponential powers to which the imaginary number "i" is raised, in achieving a solution to a problem, therefore eliminating errors associated with solutions employing mental processes.

DESCRIPTION OF THE BEST MODES FOR CARRYING OUT THE INVENTION

Figure 1:
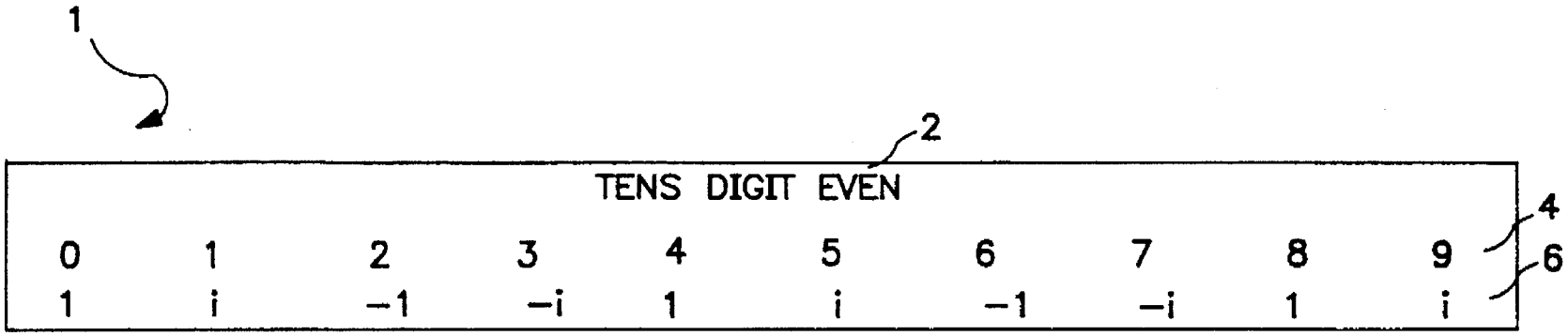
FIG. 1 of the drawing illustrates a first side of a scale in accordance with a first embodiment of the present invention.

The preferred embodiments of carrying out the invention disclosed herein will now be discussed with respect to FIGS. 1–21 of the drawing. It is initially noted that each of the several different apparatus disclosed herein employ the method of the present invention for calculating the value of the imaginary number "i" raised to different exponential powers by eliminating the step of factoring and relying upon the values of only the ones and tens digit in the manner previously discussed herein. The devices to be discussed below include structures bearing numerical and instructional indicia which are generally flat and planar in nature, such as plates, cards, sheets and similar articles. The structures may be formed from conventional materials, as for example, plastics (including clear plastic), cardboard or coated paper upon which information may be carried. Additionally, three dimensional configurations such as spheres and cubes, and device formed from movable elements and slides, are within the scope of the present invention.

Figure 2:
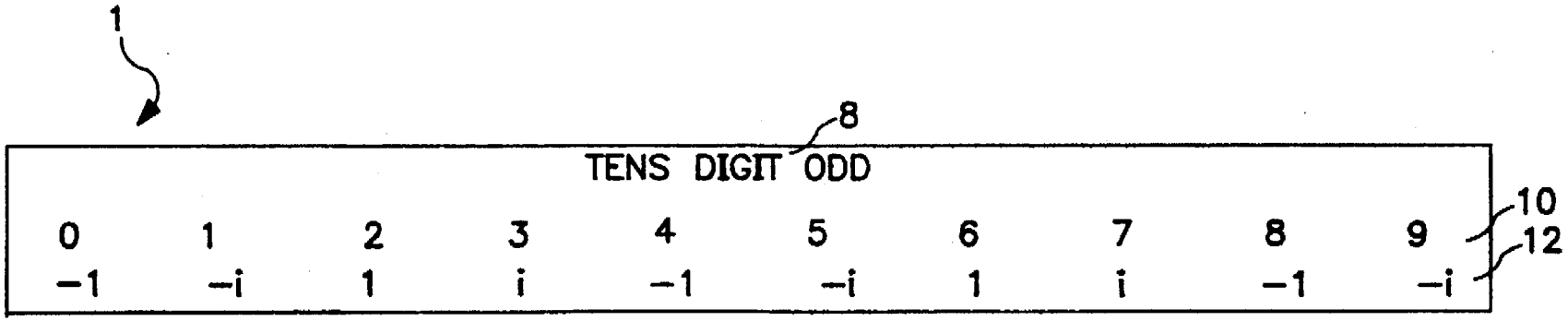
FIG. 2 illustrates the opposed side of the scale illustrated by FIG. 1 of the drawing.

Referring first to FIGS. 1–2 of the drawing, FIG. 1 illustrates a first side 2 of a rectangular shaped, longitudinally extending base designated generally by the reference numeral 1. A row 4 of numerical indicia 0–9 represents the ones digit, while row 6 designates the imaginary number "i" raised to different powers. FIG. 2 of the drawing illustrates a second side 8 of the base 1 having a row 10 representing the ones digits from 1 to 9, and a row 12 representing the imaginary number "i" raised to different exponential powers. On both sides 2 and 8 of the base 1, rows 4 and 6, and rows 10 and 12, respectively, are in vertical alignment with each other. Side 2 is used to determine the value of "i" raised to an exponential power when the tens digit of the exponent is even, while side 8 of the base 1 is used to determine the value of "i" raised to an exponential power when the tens digit of the exponent is "odd". As an example, to solve the value of "$i^{376}$", it is noted that the tens digit of the exponent "376" is "odd" and therefore reference is made to side 8 of the base 1. The "ones" digit of the exponent is "6", and the user observes the solution by referring to the digit "6" on row 10 and reading the number "1" from row 12 directly below the numeral "6" of row 10 on side 8 of the base 1.

Figure 3:
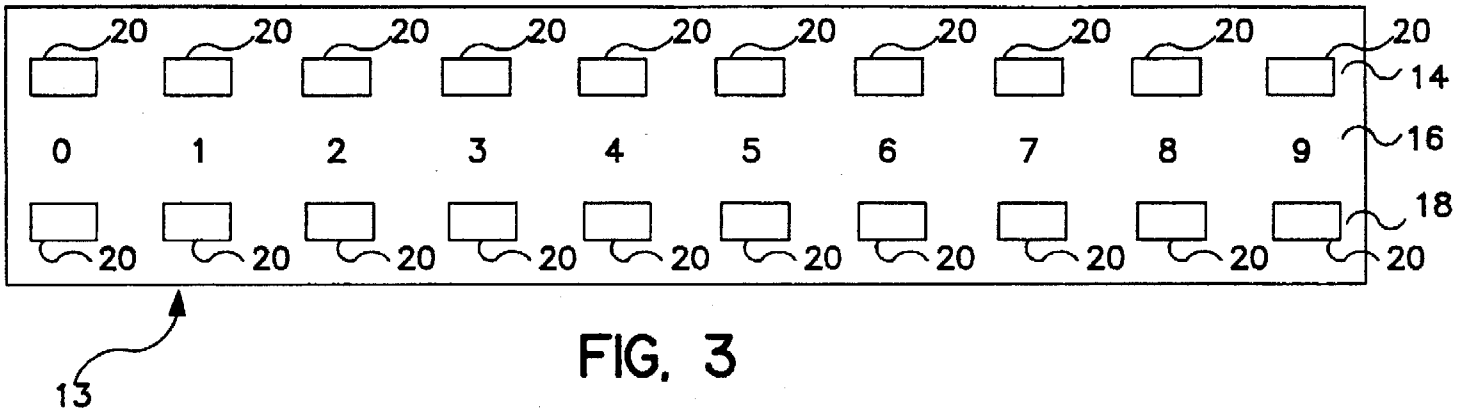
FIG. 3 of the drawing illustrates a sleeve having a plurality of windows defined on its outer surface in accordance with a second embodiment of the present invention.
Figure 4:
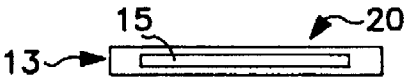
FIG. 4 illustrates a side elevational view of the sleeve illustrated by FIG. 3.
Figure 5:
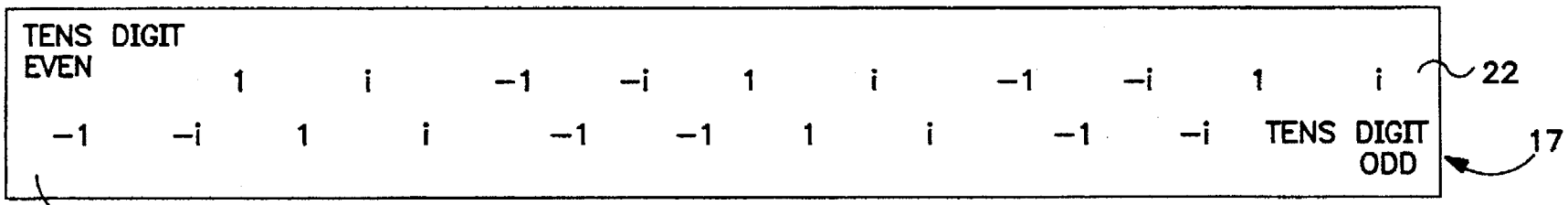
FIG. 5 illustrates a slide element which is insertable into and movable relative to the sleeve illustrated by FIGS. 3 and 4.

FIGS. 3–5 illustrate a second embodiment of the invention. A sleeve generally designated by reference numeral 13 defines a centrally disposed generally rectangular cross-sectional opening 15. An upper surface of the sleeve defines a plurality of windows or openings 20 in two linearly extending rows 14 and 18. A row of numerals designated by reference numeral 16 represents the digits 0 through 9. Row 16 is disposed between row 14 and 18, and each of the digits 0 through 9 of row 16 are in alignment with corresponding windows 20 of rows 14 and 18. FIG. 5 generally designates a slide element 17 which is fitted to be removably received within the opening 15 within the sleeve 13. Slide 17 is selectively movable relative to the sleeve 13. A first row 22 of powers of "i" when the tens digit of an exponent is "even" laterally extends across the top portion of slide 17. A second row of 24 of powers of "i" when the tens digit of the exponent is "odd" extends across the bottom portion of slide 17. The powers of row 22 are not in alignment with, but are offset from, the powers of row 24. In this manner, when slide 17 is inserted into sleeve 13 and the powers of row 22 can be observed through the windows 20 of row 14 on the sleeve, the powers of row 24 are not aligned with the windows 20 of row 18 on the sleeve and thus cannot be observed. Likewise, when the powers of row 24 are aligned with the windows of row 18 on the sleeve, the powers of row 22 are not aligned with the windows of row 14 and cannot be observed.

The device disclosed by FIGS. 3–5 can be used to solve the problem "$i^{163}$" as follows. The "tens" digit is "even" so that the slide 17 is inserted into the sleeve 13 such that the powers of row 22 are aligned and observable through the corresponding windows 20 of row 14 on the sleeve. The "ones" digit is "3" and the user locates the "3" on scale 16 of the sleeve which corresponds to the "ones" digit. The power observed in the window 20 on the scale 14 aligned with the numeral 3 on the scale 16, which will be "–i", is the solution to the problem. As noted above, when values are observable through one of the rows of windows 14 or 18 of the sleeve, the other row of windows is blank (as a result of the intentional misalignment of scales 22 and 24 on the slide) to avoid any chance of confusion by the user.

Figure 6:
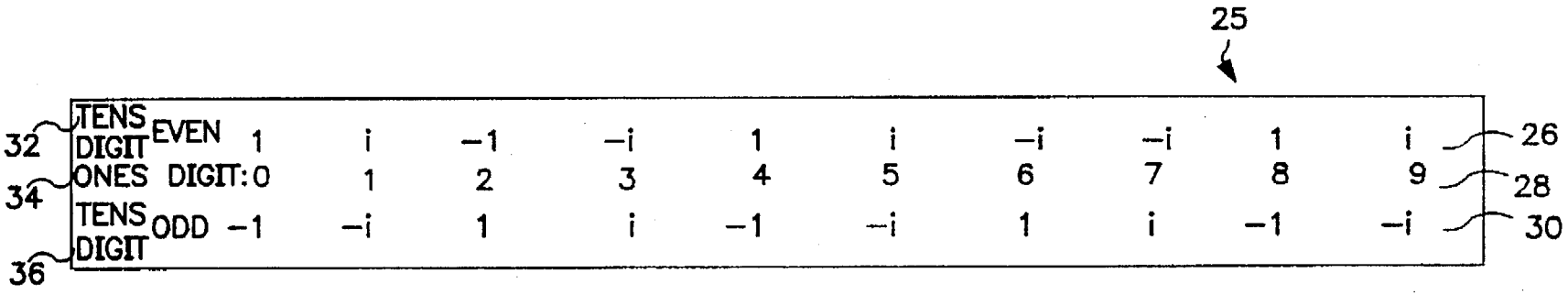
FIG. 6 of the drawing illustrates a third embodiment of the invention including a scale designating columns of information corresponding to the tens and ones digit for determining the value of the imaginary number "i" raised to different exponential powers.

FIG. 6 of the drawing illustrates a third embodiment in accordance with the present invention. A longitudinally extending, generally rectangular shaped planar base, is designated by the reference numeral 25. The base, includes three rows 26, 28 and 30 which are aligned with each other and extend laterally across one side of the base 25. Row 26 represents powers of "i" when the "tens" digit of the exponent is "even" (reference numeral 32), while row 30 represents the powers of "i" when the "tens" digit of the exponent is "odd" (reference numeral 36). Row 28, which is disposed between rows 26 and 30, represents the "ones" digit (reference numeral 34) of the exponent of the power to which "i" is raised. Effectively, the embodiment disclosed by FIG. 6 combines the two different sides of the embodiment disclosed by FIGS. 1–2 on a single outer surface of a base. For example, to use the FIG. 6 embodiment to solve the problems "$i^{290}$", it is noted that the "tens" digit is "odd" so that the user will refer to row 30. The "ones" digit is "0" and is located on row 28. The user then observes the value of the power on row 30 which is directly below the numeral 0 on row 28, indicating that the solution is "–1".

Figure 7:
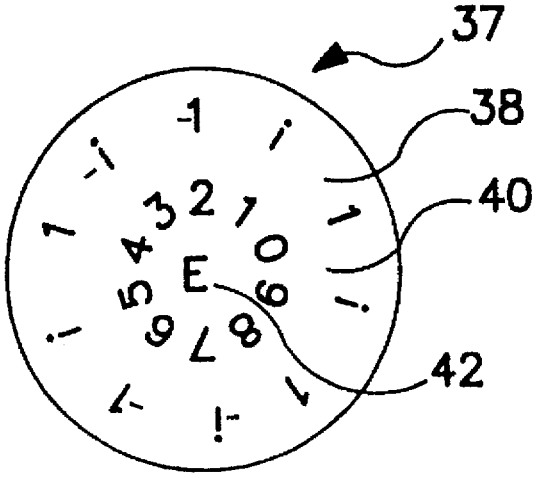
FIG. 7 illustrates a first side of a fourth embodiment of an apparatus in accordance with the present invention in which indicia for calculating the exponential value of "i" is arranged in a circular pattern.
Figure 8:
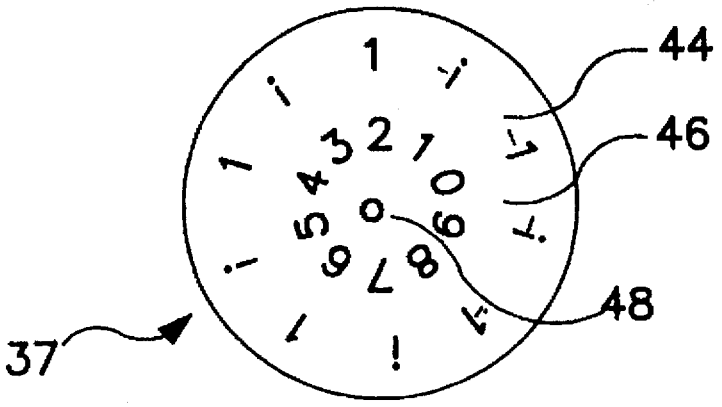
FIG. 8 is the second (opposed) side of the device illustrated by FIG. 7.

FIGS. 7–8 illustrates a fourth embodiment in accordance with the present invention. A circular shaped base is generally designated by the reference numeral 37. The circular base includes a first side surface designated by reference 42 (FIG. 7) and a second or opposed side surface designated by reference numeral 48 (FIG. 8). Surface 42, which also includes the designation "E" in the center thereof, is used when the "tens" digit of the power of "i" is even, while side surface 48, which includes the designation "0" in the center thereof, is used when the "tens" digit of the exponential power of "i" is "odd". Outer circular row 38 of side 42 represents the powers of "i", while inner concentric row 40 of side surface 42 designates the digits 0 through 9 representing the "ones" place of the exponential power of "i". Each power of "i" of row 38 is radially aligned with a different numeral of inner concentric row 40. In a similar manner, outer circular row 44 of side surface 48 represents the tens digit of the exponential power of "i", while inner concentric circular row 46 designates the numbers 0 through 9 representing the "ones" digit of the exponential power. Each power in row 44 is in radial alignment with a different one of the numerals of inner concentric row 46. As an example of the operation of the embodiment of FIGS. 7–8, the solution of "$i^{2564}$" is made as follows. The "tens" digit is "even" so side surface 42 is used. The "ones" digit of the exponent is the numeral "4", and this number is located on the inner concentric row 40 on surface 42. The numeral "4" on row 40 is in radial alignment with the numeral "1" on outer concentric row 38, and "1" represents the solution to the problem.

Figure 9:
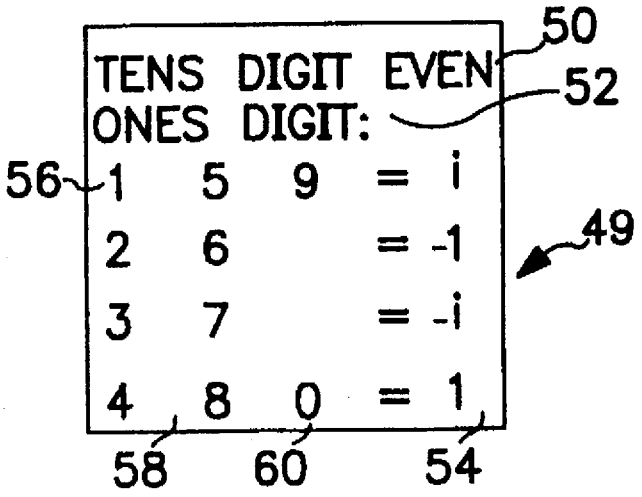
FIG. 9 illustrates a fifth embodiment of an apparatus in accordance with the resent invention in which indicia for calculating the exponential value for "i" is arranged in a square configuration.
Figure 10:
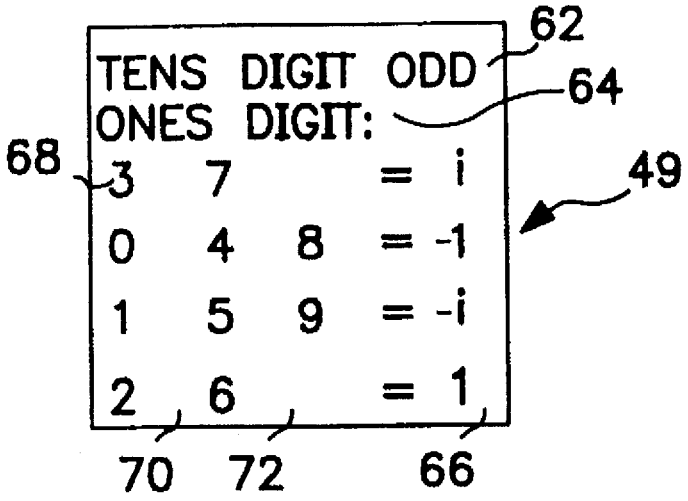
FIG. 10 illustrates a second (opposed) side of the device illustrated by FIG. 9.

FIGS. 9–10 of the drawing represent a fifth embodiment in accordance with the present invention. A square-shaped base, generally designated by reference numeral 49, includes a first side surface designed by reference numeral "50" (tens digit "even"—FIG. 9), and an opposed or second side surface designated by reference numeral 62 (tens digit "odd"—FIG. 10). Columns 56, 58 and 60 on side 50 of the base 49 represent the "ones" digit, while column 54 represents the powers of "i". Similarly, Columns 68, 70 and 72 on side 62 of the base 49 represent the "ones" digit, while Column 66 represents the powers of "i". As an example, if the embodiment of FIGS. 9–10 is used to solve "$i^{795}$", is initially noted that the "tens" digit is "odd" so that side 62 of the base 49 is used. The "ones" digit, which is "5", is located in column 70 on side 62 of the base 49, and is aligned with "–i" of column 66 which is positioned in the same row as the numeral 5 of column 70. The solution to the problem is therefore "–i".

Figure 11:
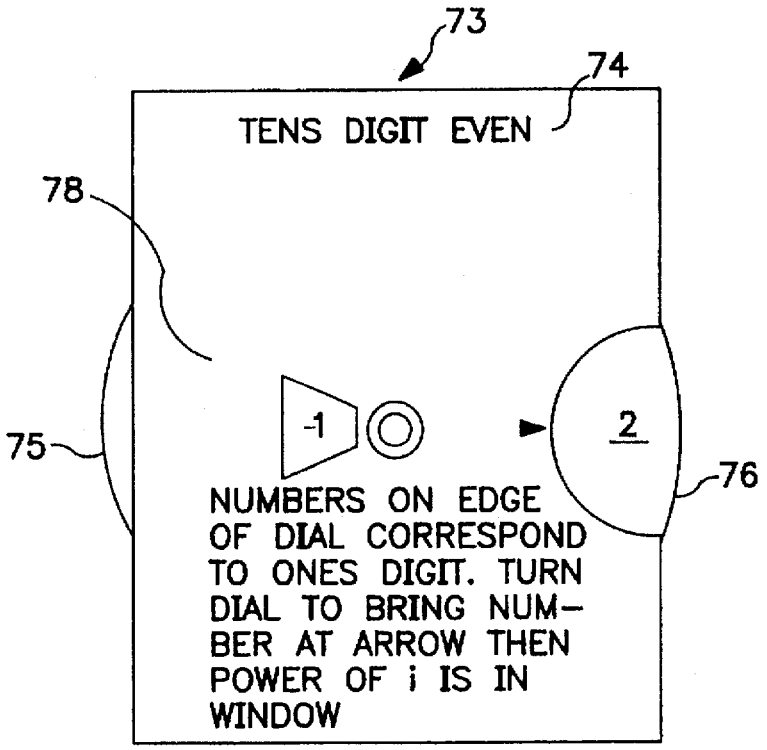
FIG. 11 illustrates a sixth embodiment of an apparatus in accordance with the present invention in which a dial is rotatable within a sleeve for selectively exposing numerical indicia through an opening.
Figure 12:
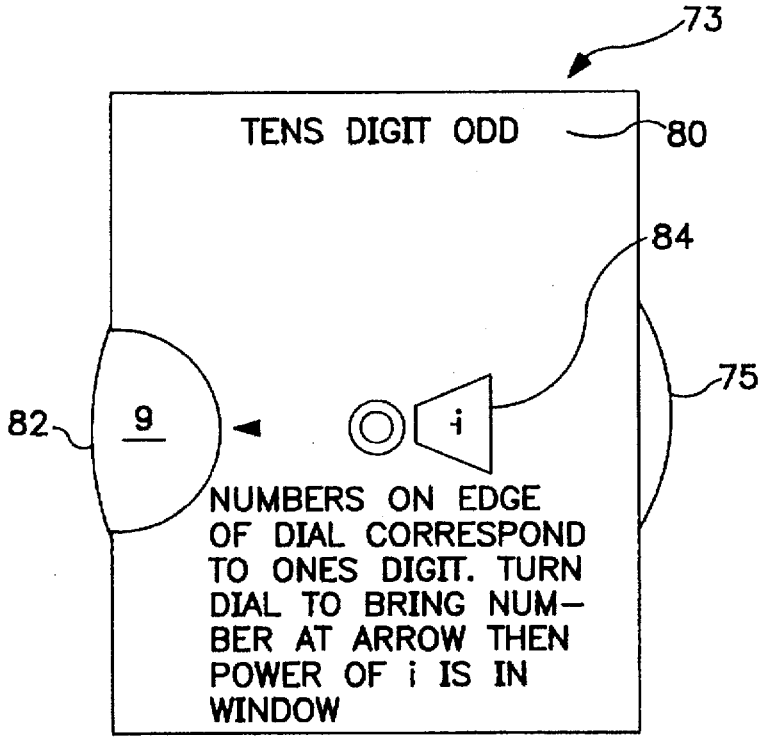
FIG. 12 illustrates a second (opposed) side of the embodiment of the invention illustrated by FIG. 11.

FIGS. 11–12 represent a sixth embodiment in accordance with the present invention. A sleeve generally designated by the reference numeral 73 has a first side 74 (tens digit "even"—FIG. 11), and a second side 80 (tens digits "odd"—FIG. 12). A circular element or dial 75 is rotatably mounted within the sleeve 73, and a notched portion of the sleeve, designated by reference numeral 76 in FIG. 11 and reference numeral 82 in FIG. 12, exposes the "ones" digit carried on the outer periphery of the rotatable circular dial 75. An opening or window designated by reference numeral 78 in FIG. 11 and 84 in FIG. 12 is defined respectively on surfaces 74 and 80 of the sleeve 73. The window 78 exposes the power of "i" corresponding to the "ones" digit exposed in the respective notched portions 76 and 82. By way of example, the solution of "$i^{402}$" using the embodiment of FIGS. 11–12 is described as follows. The "tens" digit (which is "0") is "even", and therefore side 74 of the sleeve 73 is employed. The dial 75 is rotated such that the "ones" digit "2" is displayed in notched portion 76 on the surface 74 of the sleeve 73. The solution to the problem, "−1" is displayed through the window 78 on surface 74 of the sleeve 73. The dial 75 includes concentric scales in which the "ones" digit on the outer rim of the dial is in radial alignment with the powers of "i" represented on an inner concentric row on the dial 73.

Figure 13:
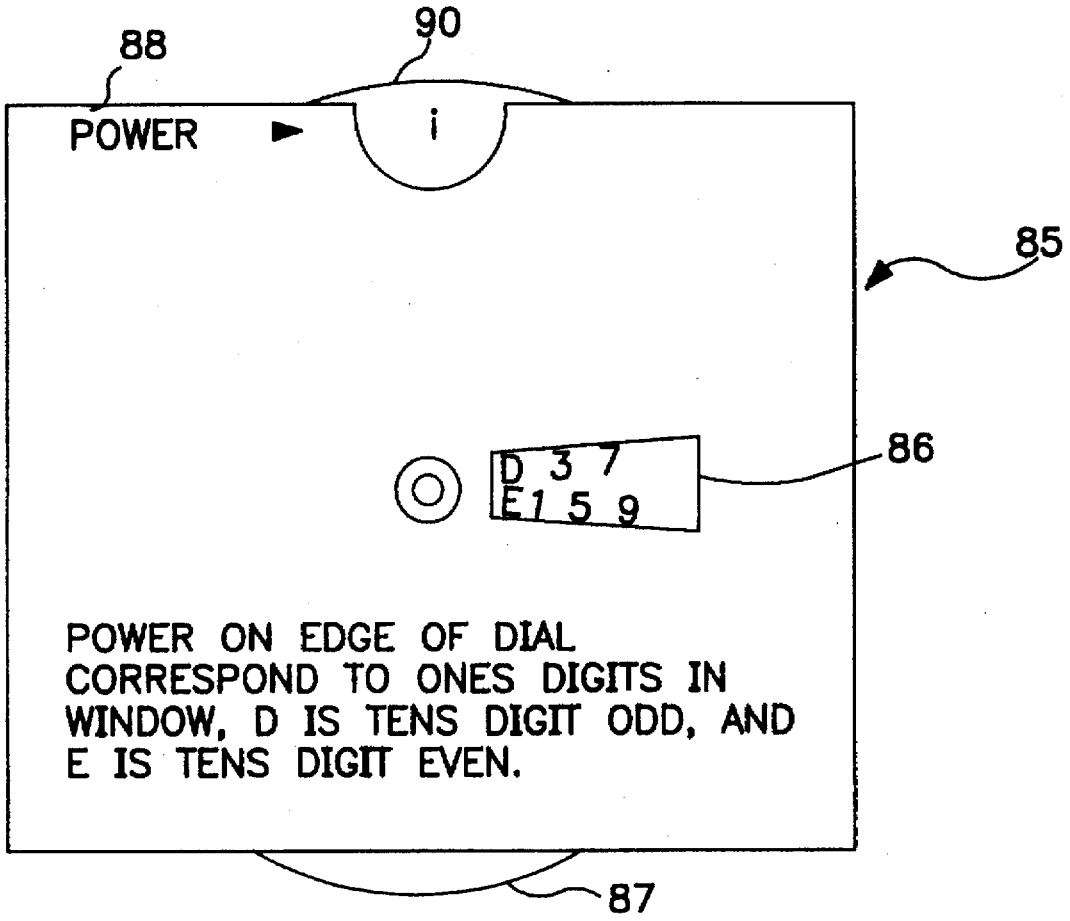
FIG. 13 illustrates a seventh embodiment of the invention in which a dial containing numerical indicia is selectively rotatable within a sleeve for exposing selected information.

FIG. 13 represents a seventh embodiment in accordance with the present invention. A sleeve 85 encloses a rotable circular element or dial 87 housed therein. The sleeve includes a notched portion 90, an opening or window portion 86, and a power designation 88. The rim of the dial 87 exposes the power of "i" in the notched portion 90 of the sleeve 85. The indicia on the dial 87 is oriented such that the designation exposed in the notched portion 90 corresponds to the information appearing in window opening 86. An example of the solution of "$i^{829}$" using the FIG. 13 embodiment is discussed as follows. The "tens" digit is the numeral "2" which is even, and the "ones" digit is the numeral "9". The dial 87 is rotated until a designation representing the numeral "9" appears on the same straight line to the right of the letter "E" in the window 86. The solution to the problem is indicated by the power which can be observed in the notched portion 90 of the sleeve 85.

Figure 16:
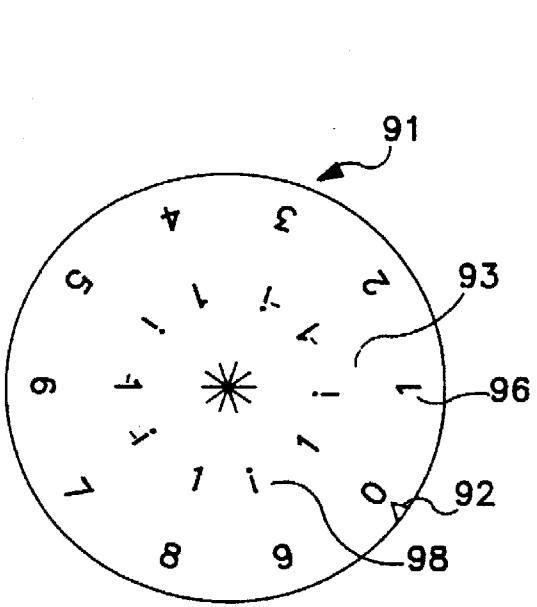
FIGS. 14, 15 and 16 illustrate an eighth embodiment of the invention formed in a hemispherical configuration with movable pointer elements and corresponding indicia scales.
Figure 15:
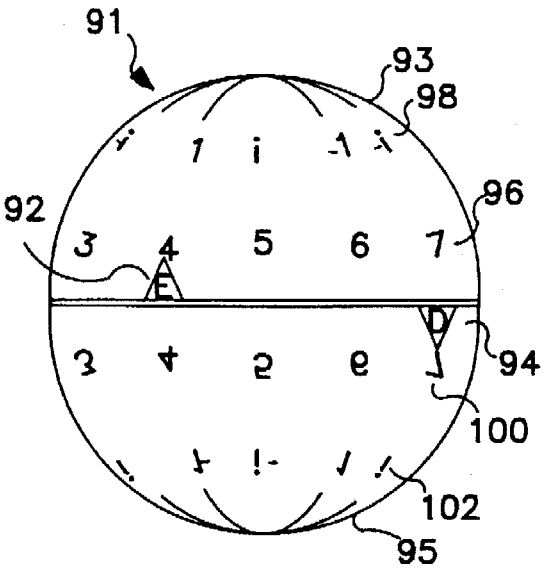
Figure 14:
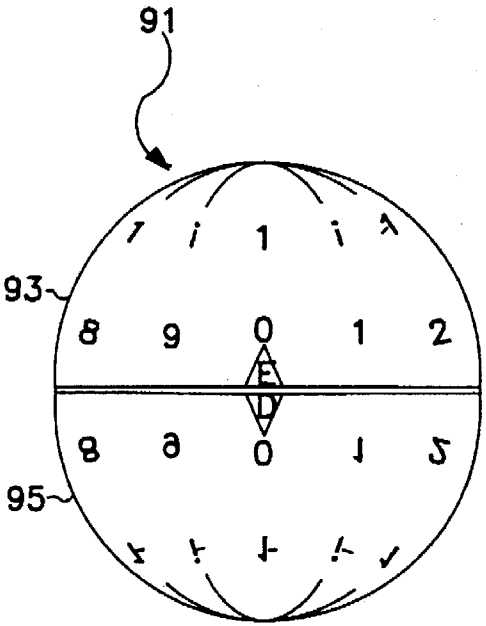

FIGS. 14–16 represent a further embodiment in accordance with the present invention. A sphere 91 is formed from two hemispheres 93 and 95. A first movable tripper 92, pointing towards the upper hemisphere 93, is movably mounted along the midpoint or equator of the sphere 91. The tripper 92 represents the "tens" digit "E" (even). A tripper 94, pointing towards the lower hemisphere 95, is also movable along the midpoint or equator of the sphere 91. The tripper 94 represents the "tens" digit "D (odd)". Aligned rows 96 and 98 on the upper hemisphere 93, represent, respectively, the ones digits from 0 through 9 and the powers of "i". Similarly, the aligned rows 100 and 102 on lower hemisphere 95 represent, respectively, the ones digit from 0 through 9 and the powers of "i". FIGS. 14–16 represent different views of the same sphere—FIGS. 14 and 15 illustrate views taken from opposed sides of the sphere 91, while FIG. 16 represents a top plan view looking down on sphere 91. An example of the solution of "$i^{824}$" using the FIGS. 14–16 embodiment of the invention is discussed as follows. The "tens" digit (which is the numeral 2) is even so the tripper 92 pointing towards the upper hemisphere 93 is used. The tripper is moved until it is aligned with the number 4, which is the "ones" digit of the exponent, in row 96, of the upper hemisphere 93. The solution to the problem is represented by the power in row 98 aligned with numeral "4" in row 96 of the upper hemisphere—namely, the numeral "1".

Figure 18:
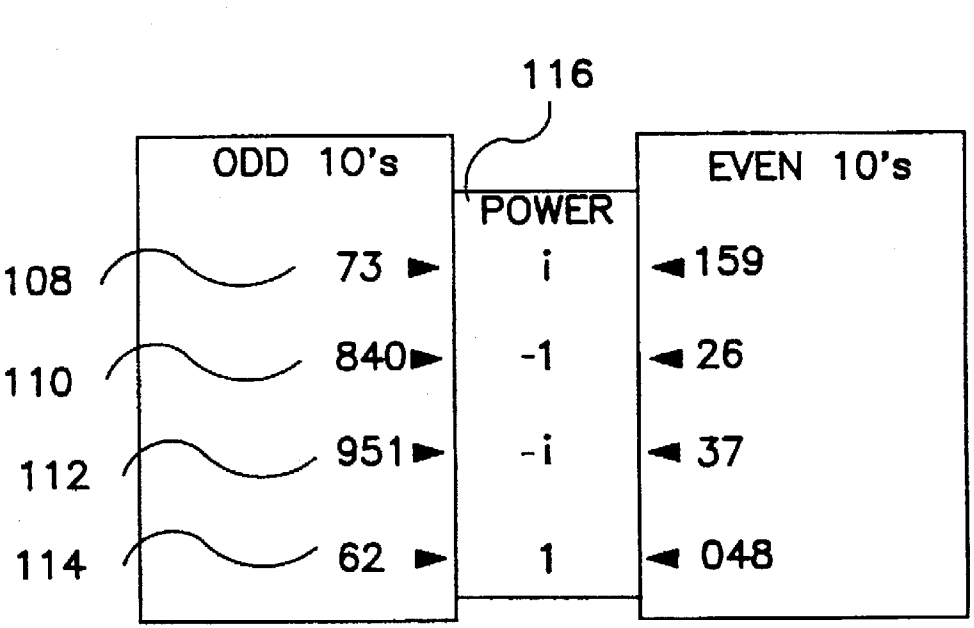
FIGS. 17–18 illustrate a ninth embodiment of an apparatus in accordance with the invention in which two joined elements are movable relative to each other for selectively exposing or concealing an intermediate element.
Figure 17:
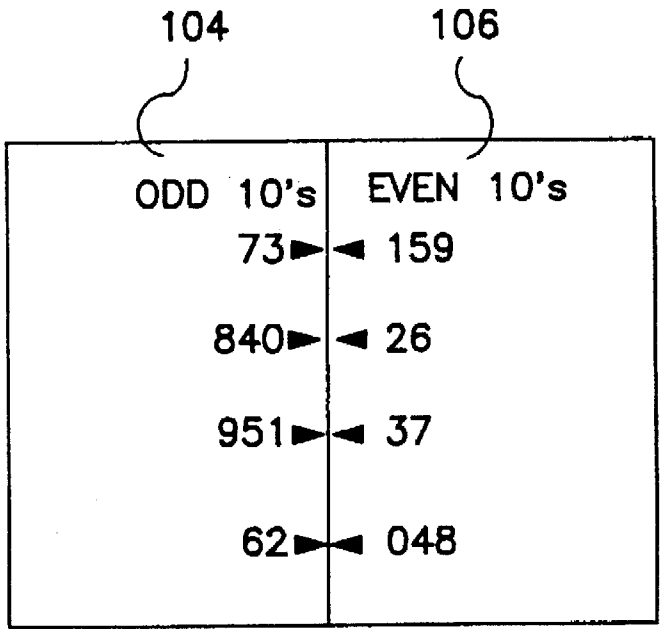

FIGS. 17–18 illustrate a further embodiment in accordance with the present invention. The device illustrated by FIGS. 17–18 includes a left element "104" and a right element "106" connected to each other and which are movable relative to each other in a lateral direction. Element 104 represents "tens" digit "odd", while element 106 represents "tens" digit "even". Four rows 108, 110, 112 and 114 laterally extend across elements 104 and 106. These rows represent the "ones" digits. As more clearly illustrated by FIG. 18, as elements 104 and 106 of FIG. 17 are moved apart from each other, an intermediate element 116, which is connected to and between both elements 104 and 106, is exposed. Element 116 represents a column of the powers of "i", and is in linear alignment with the respective rows 108, 110, 112 and 114 of elements 104 and 106, which represent the "ones" digits. An example of the solution of "$i^{334}$" with the FIGS. 17–18 embodiment of the invention is discussed as follows. The "tens" digits "3" is an "odd" number and reference is made to side element "104". The "ones" digit, which is the number "4", is located in lateral row "110" on side element "104". Side element 104 is moved relatively away from side element 106 to expose intermediate element 116. Row 110 of side element 104 is aligned with the power "−1" on the intermediate element 116, indicating that the solution to the problem is "−1".

Figure 21:
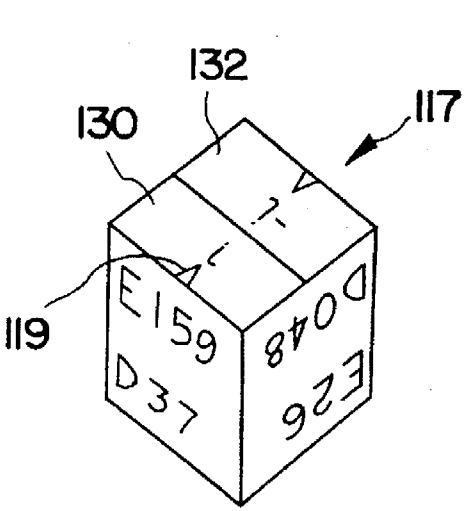
FIGS. 19–21 illustrate a tenth embodiment of a device in which a cube-shaped structure includes numerical designations for determining the value of imaginary number "i" raised to different exponential powers in accordance with the present invention.
Figure 20:
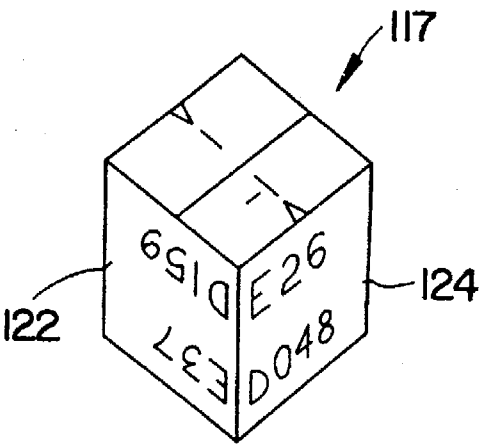
Figure 19:
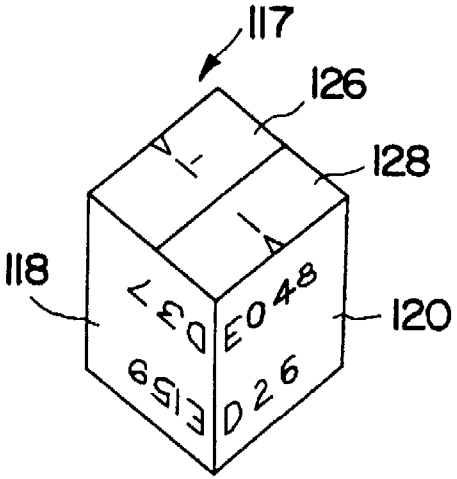

A further embodiment of the invention is illustrated by FIGS. 19–21 of the drawing. A cube-shaped structure is generally designated by the reference numeral 117. Since two variations for each of the four powers of "i" exist, four consecutive sides of the cube are labelled with the "tens" digits "even/odd" ("E" representing "even" and "D" representing "odd"), and the "ones" digit from 0 through 9. These designations appear on sides 118, 120, 122 and 124 of the cube 117. Each pair of the powers of "i" are designated at opposite ends on the cube 117—reference numerals 126, 128 (FIG. 19) represent a first end of the cube 117, and reference numerals 130, 132 (FIG. 21) represent the opposed end of the cube shape 117. Each end of the cube is divided into two separate sections so that four (4) separate sections are provided in total on the two ends of the cube, these four separate sections representing the four powers of "i". Since the powers are on opposed sides of the cube, the lettering and numerical sequences are at a 180 degree turn with each consecutive side of the cube 117. The answers to the problem are located upward and parallel to the side of the cube being read. An example of the solution of "$i^{245}$" using the embodiment illustrated by FIGS. 19–21, is discussed as follows. The "tens" digit, which is the numeral "4" is even, and the "ones" digit is the numeral "5". The cube is turned to rotate the letter "E" and the numeral "5" on the same line (which appears on side 118 of FIG. 19). The cube is then inverted so that side 118 is read upright, and an arrow 119 points to section 130 defined on the top end of cube 117. The representation of "i", which appears in Section 130, is the solution to the problem.

Other modifications, variations, and advantages within the scope of the invention will become apparent to those skilled in the art. Accordingly, the discussion of the preferred embodiments herein is intended to be illustrative only, and not restrictive of the scope of the invention, that scope being defined by the following claims and all equivalents thereto.

I claim:

1. An apparatus for determining the value of the power of the imaginary number "i", said apparatus including a base having a first outer surface carrying at least two aligned scales, one of said scales corresponding to the tens digit of an exponent to which said imaginary number "i" is raised, the other of said scales corresponding to the "ones" digit of said exponent.

2. The apparatus as claimed in claim 1 wherein said base includes two opposed outer surfaces, each of said outer surfaces including said scale corresponding to said ones digit of said exponent, one of said outer surfaces including an aligned scale corresponding to said power to which said imaginary number "i" is raised when the tens digit of said exponent is odd, the other of said outer surfaces of said base including an aligned scale corresponding to the powers of said imaginary number "i" when the tens digit of said exponent is even.

3. The apparatus as claimed in claim 2 wherein said base is generally rectangular in shape, and said scales extend laterally across said base.

4. The apparatus as claimed in claim 2 wherein said base is formed from a transparent material.

5. The apparatus as claimed in claim 1 wherein one surface of said base carries three aligned, laterally extending scales, one of said scales being centrally disposed between the other of said scales and corresponding to the ones digit of said exponent to which said imaginary number "i" is raised, and the other of said two scales corresponding, respectively, to the tens digit of said exponent when said tens digit is even, and to the tens digit of said exponent when said tens digit is odd.

6. The device as claimed in claim 1 wherein said base is circular in shape and carries two concentric scales, an outer one of said scales corresponding to the power of said imaginary number "i", and the inner concentric scale corresponding to the ones digit of said exponent to which said imaginary number "i" is raised.

7. The apparatus as claimed in claim 6 wherein said circular base includes two separate outer surfaces; one of said outer surfaces corresponding to the exponent to which said imaginary number "i" is raised when the tens digit of said exponent is even, and the other of said surfaces corresponding to said exponent of said imaginary number "i" when said tens digit of said exponent is odd; each of said surfaces including an outer concentric scale corresponding to the power of said imaginary number "i" and an inner concentric scale corresponding to the ones digit of said exponent to which said imaginary number "i" is raised.

8. The apparatus as claimed in claim 1 wherein said base is square shaped and includes two opposed outer surfaces, one of said outer surfaces corresponding to the tens digit of said exponent to which said imaginary "i" is raised when the tens digit is even, the other of said surfaces corresponding to the tens digit of said exponent to which said imaginary number "i" is raised when said tens digit is odd; each of said surfaces including a plurality of columns corresponding to the ones digit of said exponent to which said imaginary number "i" is raised.

9. The apparatus as claimed in claim 1 wherein said base comprises a spherical configuration formed from two hemispheres, each of said hemispheres including a first scale corresponding to the ones digit of an exponent to which said imaginary number "i" is raised, one of said hemispheres including a scale corresponding to the power of said exponent when said tens digit is even, and the other of said hemispheres including a scale corresponding to the power of said exponent when said tens digit is odd; a first pointer element pointing in a direction towards one of said hemispheres and being movably mounted around the outer diameter of said sphere, and a second pointer element pointing in a direction towards said second hemisphere and being movably mounted around said outer diameter of said sphere independent from the movement of said first pointer element.

10. The apparatus as claimed in claim 9 wherein said two scales on each of said first and second hemispheres are arranged concentrically relative to each other.

11. The apparatus as claimed in claim 1 wherein said base is formed in a cube configuration, each of said four adjacent sides of said cube carrying scales corresponding to the ones digit of an exponent to which said imaginary number "i" is raised when the tens digit of said exponent is odd and when the tens digit of said exponent is even.

12. The apparatus as claimed in claim 11 wherein said two opposed upper and lower ends of said cube carry scales representing the power of said imaginary number "i" and corresponding to said scales on said adjacent side of said cube when said scales on said side of said cube are oriented in an upright position.

13. An apparatus for determining the power of the imaginary number "i", said apparatus including a sleeve having a first notched portion proximate to one end thereof and an opening defined on at least one outer surface of said sleeve; a circular element rotatably mounted within the sleeve, said circular element carrying at least two concentric scales, one of said scales corresponding to the ones digit of said exponent to which said imaginary number "i" is raised, and the other of said scales corresponding to the power of said imaginary "i"; said power of said imaginary number "i" in said opening corresponding to said ones digit observed in said first notched portion of said sleeve.

14. The apparatus as claimed in claim 13 wherein said first notched portion in said sleeve and said openings defined in said sleeve are in linear alignment with each other.

15. The apparatus as claimed in claim 14 wherein said first notched portion in said sleeve and said opening therein are disposed across the center of said sleeve.

16. The apparatus as claimed in claim 13 wherein said sleeve includes two outer surfaces, each of said outer surfaces defining a notched portion and an opening, said circular element rotabably mounted within said sleeve including opposed outer surfaces, each of said outer surfaces carrying at least two scales, one of said scales on each of said outer surfaces corresponding to the ones digit of the exponent to which the imaginary number "i" is raised, the other of said scales on each of said outer surfaces of said circularly rotatable element corresponding, respectively, to the power of said imaginary number "i" when the tens digit of the exponent to which said imaginary number "i" is raised is even, and when the tens digit of the exponent to which the imaginary number "i" is raised is odd.

17. An apparatus for determining the power of the imaginary "i", said apparatus including first and second connected elements, said first and second elements being movably mounted relative to each other; said first element including a scale corresponding to the tens digit of an exponent to which said imaginary number "i" is raised when said tens digit is odd, said second element including a scale corresponding to the tens digit of an exponent to which said imaginary number "i" is raised when said exponent is even; each of said first and second elements including rows of digits corresponding to the ones digit of said exponent; and an intermediate element connected to and mounted between said first and second elements, said intermediate member including a scale selectively exposed by moving said first and second elements relatively apart from each other, said scale on said intermediate element corresponding to the power of said imaginary number "i".

18. The apparatus as claimed in claim 17 wherein said scale on said intermediate element includes rows aligned with rows on said first and second elements when said first and second elements are moved relatively apart from each other to expose said scale on said intermediate element.

* * * * *